US005442892A

United States Patent [19]

Burns, III et al.

[11] Patent Number: 5,442,892

[45] Date of Patent: Aug. 22, 1995

[54] SYSTEM FOR FACILITATE RECYCLING GOODS FROM DEFECTIVE PACKAGES ON A BLISTER PACKAGING MACHINE

[75] Inventors: Henry K. Burns, III; Hubert E. Burns, both of Dothan, Ala.; Thomas P. DiNardo, Raleigh; James E. Ingram, Angier, both of N.C.

[73] Assignee: Glaxo Inc., Research Triangle Park, N.C.

[21] Appl. No.: 184,431

[22] Filed: Jan. 14, 1994

[51] Int. Cl.[6] ..... B65B 57/10; B65B 69/00; B65B 47/02

[52] U.S. Cl. ..... 53/53; 53/54; 53/453; 53/495; 53/559

[58] Field of Search ..... 53/53, 54, 495, 498, 53/499, 453, 454, 559, 560, 900; 209/643, 936

[56] References Cited

U.S. PATENT DOCUMENTS

| | | | |
|---|---|---|---|
| 2,008,870 | 7/1935 | Little | 209/80 |
| 2,922,445 | 1/1960 | Osmond et al. | 141/170 |
| 3,533,212 | 10/1970 | Borel et al. | 53/53 |
| 3,686,059 | 8/1972 | Auer | 156/581 |
| 3,721,340 | 3/1973 | Kruse et al. | 53/53 X |
| 3,882,316 | 5/1975 | Garris | 250/560 |
| 3,889,447 | 6/1975 | Garris | 53/53 |
| 3,980,180 | 9/1976 | Jamieson | 209/111 |
| 4,094,129 | 6/1978 | List | 53/54 |
| 4,094,439 | 6/1978 | List | 221/9 |
| 4,144,970 | 3/1979 | McKnight et al. | 209/542 |
| 4,172,526 | 10/1979 | Moser | 209/209 |
| 4,191,294 | 3/1980 | McGrath, Jr. et al. | 53/53 X |
| 4,405,049 | 9/1983 | Deitz | 209/209 |
| 4,472,922 | 9/1984 | Romagnoli | 53/53 |
| 4,802,323 | 2/1989 | Garris et al. | 53/53 |
| 4,814,072 | 3/1989 | Von Wichert et al. | 209/53 |
| 4,909,414 | 3/1990 | Heath | 221/25 |
| 4,916,883 | 4/1990 | Focke | 53/53 |
| 4,964,262 | 10/1990 | Moser et al. | 53/53 X |
| 4,975,015 | 12/1990 | Harding | 414/412 |
| 5,033,251 | 7/1991 | Rodrigues | 53/54 |
| 5,040,353 | 8/1991 | Evans et al. | 53/54 |
| 5,081,816 | 1/1992 | Cardinali | 53/54 |
| 5,101,612 | 4/1992 | Yamamoto et al. | 53/53 |

FOREIGN PATENT DOCUMENTS

| | | | |
|---|---|---|---|
| 0009538 | 4/1980 | European Pat. Off. | B65B 69/00 |
| 0059638 | 9/1982 | European Pat. Off. | B65B 69/00 |
| 0351381 | 1/1990 | European Pat. Off. | B65B 69/00 |
| 0401103 | 12/1990 | European Pat. Off. | 53/53 |
| 0465437 | 1/1992 | European Pat. Off. | B65B 35/18 |
| 1955359 | 1/1971 | Germany . | |
| 2638934 | 3/1978 | Germany | 53/53 |
| 3842273 | 6/1989 | Germany | B65B 1/30 |
| 1458609 | 11/1974 | United Kingdom | B30B 11/08 |
| 2014725A | 2/1978 | United Kingdom | G01N 21/30 |
| 2002512 | 2/1979 | United Kingdom | G01N 23/22 |
| 2014725 | 8/1979 | United Kingdom | G01N 21/30 |
| 2059381 | 4/1981 | United Kingdom | G10M 3/36 |
| 2067155 | 7/1981 | United Kingdom | B65B 69/00 |
| 2067155B | 12/1981 | United Kingdom | B65B 69/00 |
| 2269354 | 2/1994 | United Kingdom | B65B 1/46 |

*Primary Examiner*—James F. Coan

*Attorney, Agent, or Firm*—Richard E. Jenkins

[57] ABSTRACT

A pneumatic apparatus for withdrawing goods from defective blister packages on a blister packaging machine and comprising a pair of spaced-apart and laterally shiftable vacuum heads reciprocally mounted above the carrier strip between the detection station and the sealing station of the blister packaging machine so that when one head is in vertical registration with the carrier strip the other head is laterally offset from the carrier strip. Each vacuum head comprises a plurality of suction elements depending from the bottom thereof which are adapted to selectively engage a predetermined plurality of goods on the carrier strip. Control means are operatively associated with pneumatic means adapted for sequentially causing each of said pair of spaced-apart heads when operatively positioned over the carrier strip to descend, pneumatically engage a selected portion of the plurality of goods, return to the elevated first position, and laterally shift to the offset inoperative position to release the plurality of goods into a goods collection bin. Next, the other head which is now in position over a new intermittently advanced segment of the carrier strip repeats the same cycle as the first vacuum head and releases the goods collected thereby into a goods collection bin on the other side of the carrier strip.

25 Claims, 11 Drawing Sheets

SYSTEM FOR FACILITATE RECYCLING GOODS FROM DEFECTIVE PACKAGES ON A BLISTER PACKAGING MACHINE

TECHNICAL FIELD

The present invention relates to a machine for the production of blister packages, and more particularly to a system to pneumatically withdraw the remaining goods from a defective blister section to facilitate subsequent recycling of the goods.

RELATED ART

In conventional state-of-the-art blister packaging machines (such as the UHLMANN Model No. USP 4MT intermittent motion blister packaging machine) the blister package formation essentially proceeds as follows: first a rolled stock or carrier strip enters the forming station where a set of punches and dies dimensioned to the correct blister layout forms a pattern of blister cavity sections (for example, two end-to-end 2×5 cavity sections or matrices across the carrier strip width) in which goods such as pharmaceutical tablets or capsules will be subsequently deposited. Next, the carrier strip with the blister cavities formed therein advances to the feeding station where the goods are placed in the blisters. Subsequent to the feeding station, a detection station of the blister packaging machine verifies the presence of the goods (for example, pharmaceutical tablets or capsules) in each cavity of each blister section across the width of the carrier strip.

The inspection task of the detection station may be accomplished by suitable electromechanical or electronic means including optical scanning or a matrix of mechanical plunger switches. If one or more cavities of a blister section are determined to be empty, this is noted in the electrically connected blister package machine controller so as to enable the defective blister section to be rejected. For example, if one pharmaceutical tablet in a 2×5 blister section is determined to be missing at the detection station, the entire blister section is considered to be defective, and the controller will cause the completed blister package (including the nine pharmaceutical tablets therein) to be rejected at the end of the blister packaging process.

Next, the carrier strip advances to the sealing station where a suitably printed lidding stock or cover strip is thermobonded to the carrier strip so as to hermetically seal the blisters within the carrier strip. The carrier strip with the lidding stock thermobonded thereto now advances through a cooling station to the perforating station where the individual blister packages are separated or sheared from across the width of the thermobonded carrier strip. For example, two 2×5 blister packages may be separated from across the width of the intermittently advancing thermobonded carrier strip corresponding to the blister pattern previously created at the forming station.

Finally, the conventional state-of-the-art blister packaging machine utilizes vacuum-actuated transfer cups (or other suitable means) to transfer the individual blister packages to a subsequent conveyor after being separated out of the carrier strip unless an error signal is received from the controller indicating that a specific blister package is defective. In that circumstance, a mechanical reject mechanism pushes the corresponding defective blister into a reject bin. Unfortunately, it is now commonly necessary to dispose of the content of the defective packages when using blister pack packaging machines such as the UHLMANN Model No. UPS 4MT since retrieval of the remaining goods therein is not commercially feasible. This can result in a considerable increase in manufacturing costs since the discarded goods are typically relatively expensive and the number of defective packages can be significant.

Efforts are well known in the prior art to attempt to overcome the problem described hereinabove in certain blister packaging machines. For example, one conventional recovery method entails processing defective blister packages through a special punch-and-die apparatus wherein the punch pushes the goods out of the blister package through the lidding layer. For pharmaceutical tablets, however, this presents an "elegance" problem since the recovery tablets suffer substantial breakage as well as acquiring specks of ink thereon which mar the appearance of the tablets for recycled usage. Another goods recovery method entails shearing of the cavities formed in a blister package in order to release the goods (for example, pharmaceutical tablets or capsules) contained therein. Unfortunately, this method also has been found to be unsatisfactory with pharmaceutical tablets since particles of foil and/or polymer from the packaging materials tend to become intermingled with the recovered goods and to prevent the desired objective of recycling of the recovered goods.

Yet another technique for goods recovery on a blister package machine which is well known in the art consists of having the blister packaging machine operator manually insert goods into empty blisters between the goods feeding and sealing stations. This procedure is feasible when only an occasional empty cavity is created during use of the blister packaging machine. However, as is well known to those familiar with the commercial use of blister packaging machines for blister packaging of pharmaceutical tablets or capsules, when sporatic goods feeding occurs multiple goods misfeeds tend to result in multiple empty blisters. This result renders it substantially impractical to manually insert the goods into empty blisters during commercial use of the blister packaging machine.

Of note, U.S. Pat. No. 5,040,353 to Evans et al. (assigned to Glaxo Inc., the assignee of the instant application) discloses a pharmaceutical tablet and/or capsule recycling system which utilizes a novel manifold positioned over the advancing carrier strip to selectively create a partial vacuum in one of a plurality of chambers defined in the bottom of the manifold so as to remove goods from a predetermined portion of a carrier strip representing a defective blister section. Unfortunately, although the novel manifold device represents a significant advancement in the art of high speed goods removal from a defective blister section of a carrier strip, the recycling system has a tendency to chip or otherwise degradate withdrawn goods being propelled by air pressure from the manifold to the hopper.

Therefore, the blister packaging machine art has to date only been able to successfully address incompletely filled blister packages by segregating the defective packages from the nondefective packages at the end of the blister package forming process. This typically results in high costs associated with loss of the remaining goods in defective packages. Although considerable effort has been made to develop a commercial system to recycle goods from incompletely filled or defective blister packages, all systems presently known to applicants have been found to be less than satisfactory with respect to goods such as pharmaceutical tablets or capsules.

In addition to U.S. Pat. No. 5,040,343 to Evans et al., representative related art includes Offenlegungsschrift No. 1 955 359 and European Patent Application No. 0 401 103 which both also disclose earlier efforts at selected vacuum removal of tablets from defective blister sections (or matrices) and transporting of the removed goods to a hopper for recycling.

SUMMARY OF THE INVENTION

In accordance with the invention, applicants provide an improved pneumatic system for inspecting and recovering goods on a blister packaging machine during the formation of the blister packages but prior to the sealing thereof. The recovery system meets a long-felt need for a commercial goods recovery system to recover goods from partially filled defective blister packages. Thereby, the system provides significant savings to the user of blister packaging machines by allowing the recovered goods to be recycled for use by the blister packaging machine.

The pneumatic goods recovery system of the invention is used in conjunction with conventional blister packaging machinery such as the UHLMANN Model No. UPS 4MT. The apparatus comprises a pair of spaced-apart and laterally shiftable vacuum heads which are reciprocally mounted above the carrier strip so that when one head is in vertical registration with the carrier strip the other head is laterally offset therefrom. Each vacuum head comprises a plurality of suction elements depending from the bottom thereof which are adapted to engage a predetermined plurality of goods on the carrier strip. First pneumatic means are associated with the vacuum heads for vertically shifting each of the heads from an elevated first position to a lowered goods-contacting second position and back again to the elevated first position when the vacuum head is positioned over the carrier strip.

Second pneumatic means are associated with the pair of vacuum heads for laterally shifting the heads so that as one head is shifted from a first inoperative position laterally offset from the carrier strip to a second operative position in vertical registration with the carrier strip and then back to the first inoperative position, the other head is simultaneously being shifted from a first operative position in vertical registration with the carrier strip to a second inoperative position laterally offset from the carrier strip and back to the first operative position. Third pneumatic means are associated with each of the vacuum heads for providing a vacuum to a selected portion of the suction elements thereof for a predetermined period of time.

Goods collection means are provided adjacent to each side of the carrier strip so as to provide a portion thereof beneath each of the heads when the head is in its laterally offset inoperative position. Finally, control means are cooperatively associated with the first pneumatic means, the second pneumatic means and the third pneumatic means for sequentially causing each of the pair of spaced apart heads when operatively positioned over the carrier strip to descend from the first position, pneumatically engage a selected portion of a plurality of goods with the suction elements thereof, return to the first position, shift to the laterally offset inoperative position over the goods collection means and pneumatically release the plurality of goods therein.

Thus, upon receiving a signal from the detection station, the novel pneumatic goods recovery apparatus of the invention will pneumatically withdraw the goods (e.g., pharmaceutical tablets or capsules) from selected portions of the carrier strip from which blister sections will be formed and which each have one or more empty blisters therein, and then deposit the goods in the goods collection means adjacent to the carrier strip. In this fashion, goods from defective blister packages can be continuously collected during the blister package formation process on the blister packaging machine in such a fashion that there is no damage to the goods and they may be subsequently recycled for subsequent packaging by the machine.

It is therefore the object of the present invention to provide a system for recovering the goods from defective packages during the blister package formation process on a blister packaging machine.

It is another object of the present invention to provide a system for recovering goods from defective packages during the blister package formation process for subsequent reuse in such a fashion so as not to impart any damage to the goods being recovered.

It is another object of the present invention to provide a pneumatic goods recovery apparatus which minimizes degradating forces applied to the goods during recovery and which can be readily installed on existing blister packaging machines.

It is still another object of the present invention to provide a pneumatic goods recovery apparatus for use on a conventional blister packaging machine to reduce the loss of goods during blister packaging and to thereby enhance profitability of the manufacturing process for the blister packaged goods.

Some of the objects of the invention having been stated, other objects will become evident as the description proceeds, when taken in connection with the accompanying drawing described in detail below.

BRIEF DESCRIPTION OF THE DRAWINGS

FIG. 1 shows an alternative embodiment of the goods collection system adjacent the carrier strip guide;

BEST MODE FOR CARRYING OUT THE INVENTION

Figure 1:
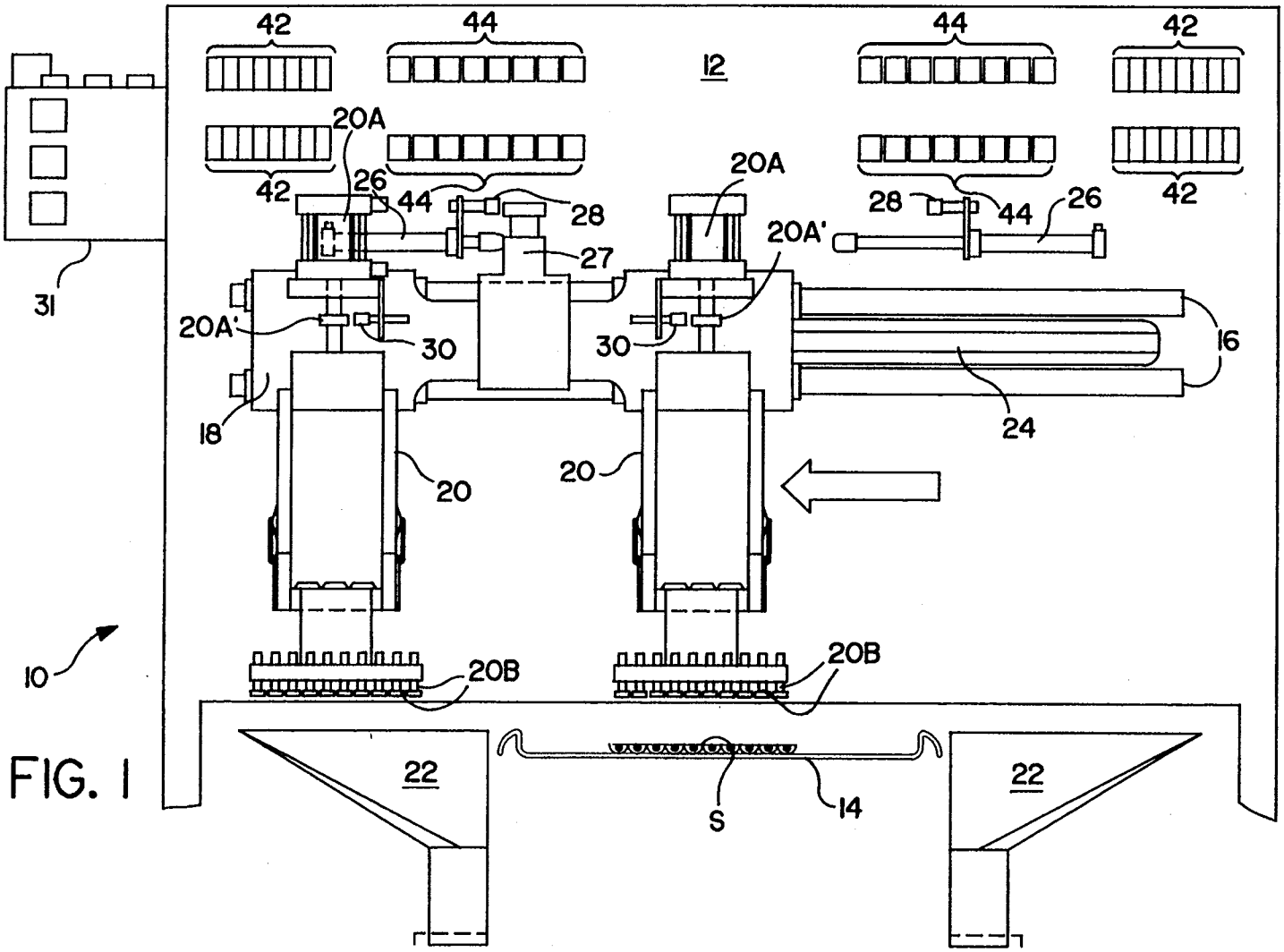
FIG. 1 shows a front elevation view (with pneumatic and electrical connections removed for clarity) of the apparatus of the invention with a carrier strip passing under one of the vacuum heads thereof, wherein one of said vacuum heads is in its elevated first position above the goods on the carrier strip.

Referring now to FIGS. 1–10 of the drawings, a preferred embodiment of a pneumatic system for recovering pharmaceutical goods (e.g., tablets, capsules, caplets, soft gels, lozenges and suppositories) from defective packages on a blister packaging machine in accordance with the present invention is shown and generally designated 10. As has been stated hereinbefore, apparatus 10 is intended for use on many different types of commercial blister packaging machines but is particularly well suited for use in conjunction with an UHLMANN Model No. UPS 4MT intermittent motion blister packaging machine.

Goods recycling apparatus 10 comprises a primary housing 12 which is mounted to the blister packaging machine (not shown) between the inspection and sealing stations so as to straddle carrier strip S and carrier strip guide track 14. A front elevation view of primary housing 12 which faces the inspection station of the blister packaging machine is shown in FIGS. 1–3 and 5, and the rear elevation view of primary housing 12 facing the sealing station of the blister packaging machine is shown in FIG. 4. As can be appreciated with reference to the aforementioned drawings, goods recycling apparatus 10 further comprises a pair of horizontally extending guide rails 16 mounted to the face of primary housing 12 and adapted to accommodate lateral sliding movement thereon by vacuum head support frame 18. Vacuum head support frame 18 may be constructed in any suitable fashion which would be well known to one skilled in the art in order to accommodate reciprocal lateral sliding movement from one end to the other end of horizontally extending guide rails 16. Most suitably, vacuum head support frame 18 includes slots at the top and bottom thereof which slidably receive guide rails 16 therethrough so as to facilitate lateral sliding movement of frame 18 thereon.

With reference to FIGS. 1–8 of the drawings, it can further be appreciated that support frame 18 carries two spaced-apart vacuum heads 20 which are configured so that when vacuum head support frame 18 moves to one end of guide rails 16 the innermost vacuum head 20 will be in vertical registration with carrier strip S (supported by carrier strip guide track 14) and the outermost vacuum head 20 will be positioned in vertical registration with collection bin 22 adjacent carrier strip guide track 14. Collection bin 22 is located on both sides of carrier strip guide track 14 and may, as a matter of design choice, be formed either from two separate collection bins 22 or each open collection bin 22 lead to a common goods container (see FIG. 1A). Thus, when one vacuum head 20 is in an operative position over carrier strip S the other spaced- apart vacuum head 20 is always in an inoperative position over one of collection bins 22 positioned on each side of carrier strip guide track 14.

Each of the spaced-apart pair of vacuum heads 20 comprises a pneumatic cylinder 20A mounted to support frame 18 for vertically shifting the head, and a plurality of suction cups 20B depending downwardly from the bottom face thereof which are suitably configured so as to correspond in number with a pre-determined number of goods-carrying blisters defined within carrier strip S. For example, if the blister forming station of the blister packaging machine is set up to form a blister layout of two lengthwise extending $2\times5$ blister sections across the width of carrier strip S and four $2\times5$ sections in the linear direction per each intermittent advancement of carrier strip S, each of vacuum heads 20 will be formed with a matrix of $10\times8$ (width$\times$length) suction cups 20B to address the corresponding $10\times8$ blisters defined within one intermittent advancement of carrier strip S beneath vacuum head 20.

Suction cups 20B are connected to a vacuum source and may be actuated to selectively address one or more of the eight $2\times5$ blister sections (see FIG. 9) which the detection station may have determined have one or more empty blisters (or cavities). The details of the pneumatic system utilized by the two spaced-apart vacuum heads 20 of the present invention will be described in detail below. Applicants wish to note, however, that the blister section layout formed across the width and a predetermined length of carrier strip S may be of substantially any suitable configuration wherein a corresponding number of suction cups 20B are provided at the lowermost end of each of vacuum heads 20 to pneumatically engage, as required, the remaining goods in each defective blister section to remove and collect same in a manner which will also be described in detail hereinafter.

Figure 1A:
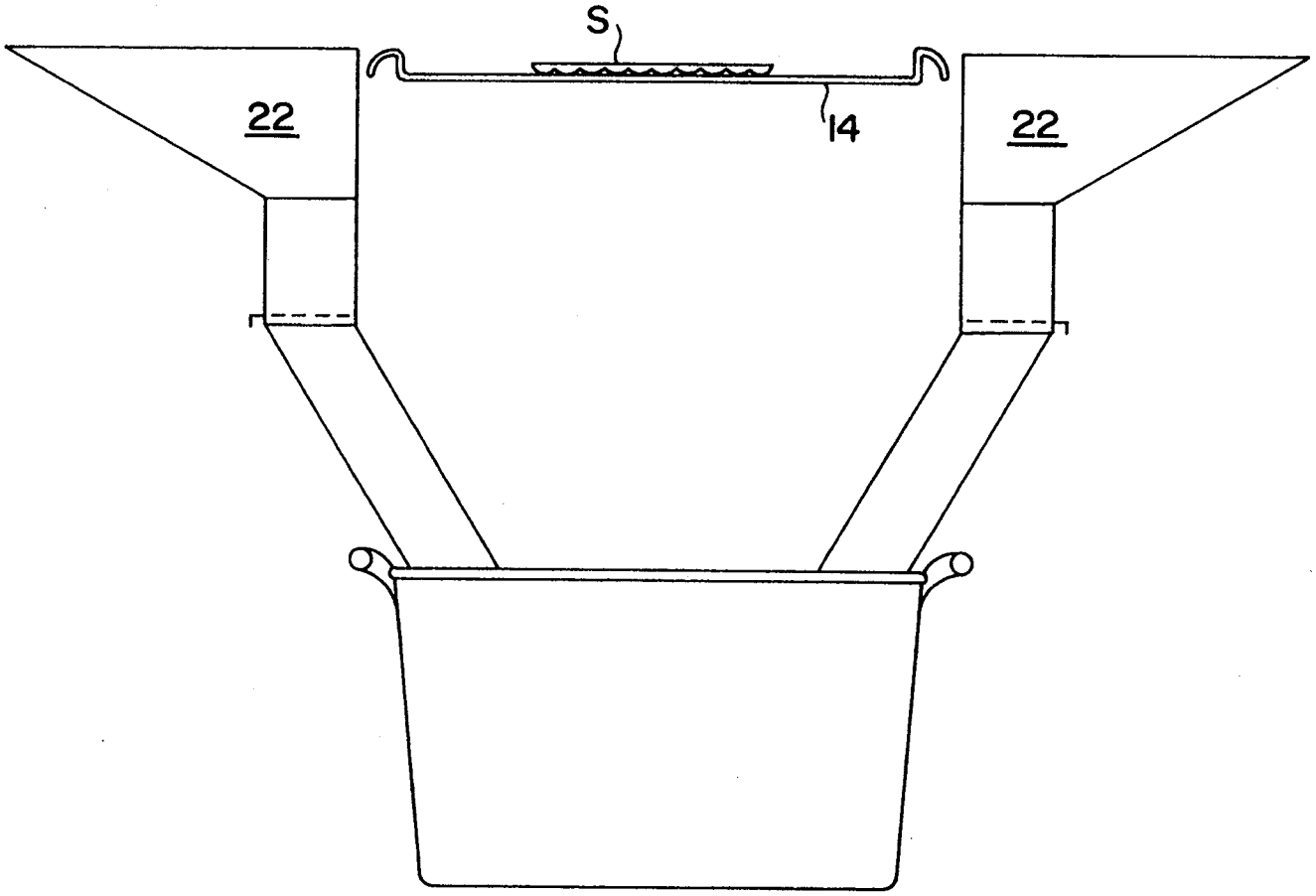
Figure 2:
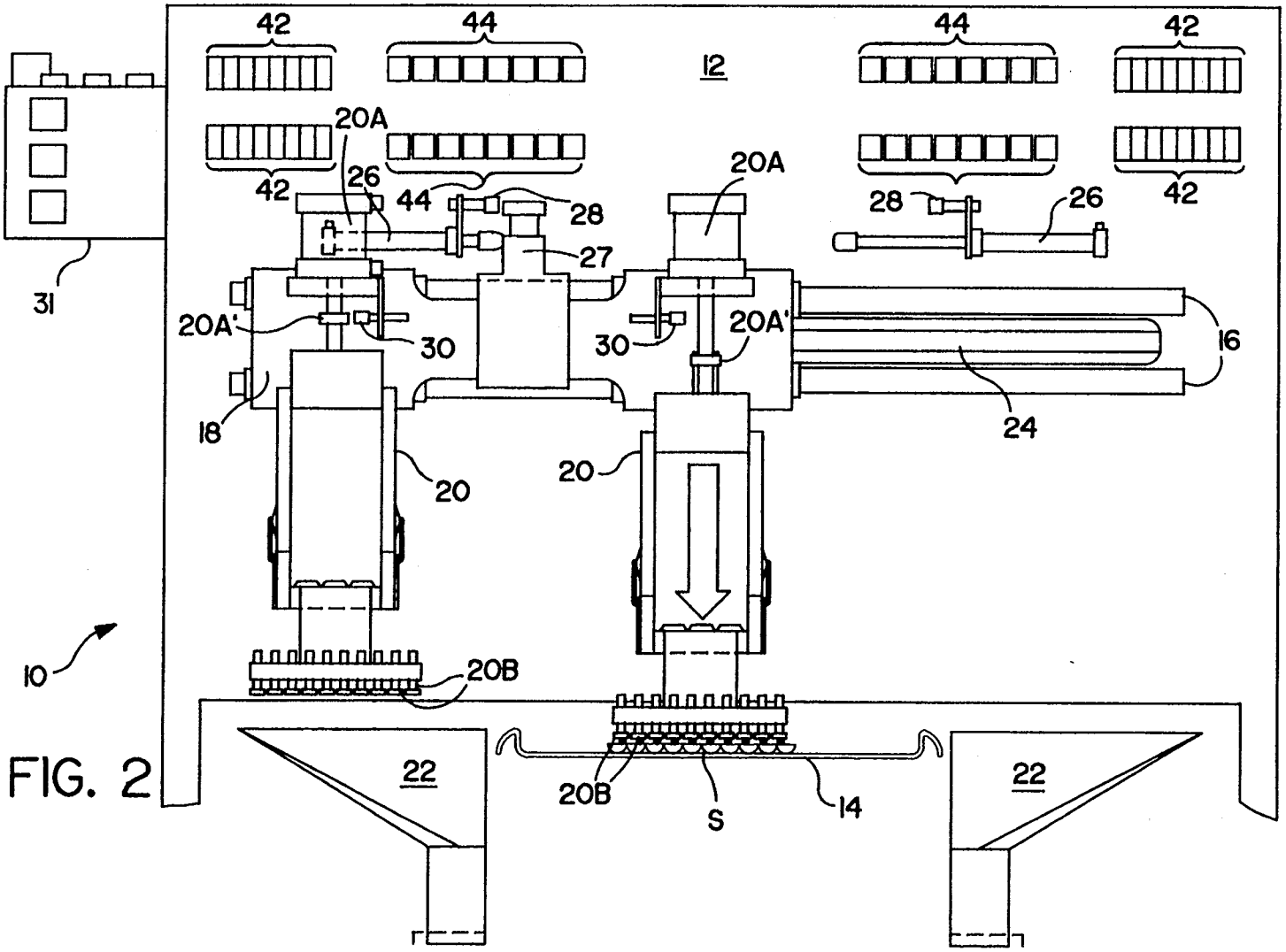
FIG. 2 shows a front elevation view (with pneumatic and electrical connections removed for clarity) of the apparatus of the invention wherein the vacuum head has been vertically shifted from its elevated first position to a lowered goods-contacting second position.
Figure 3:
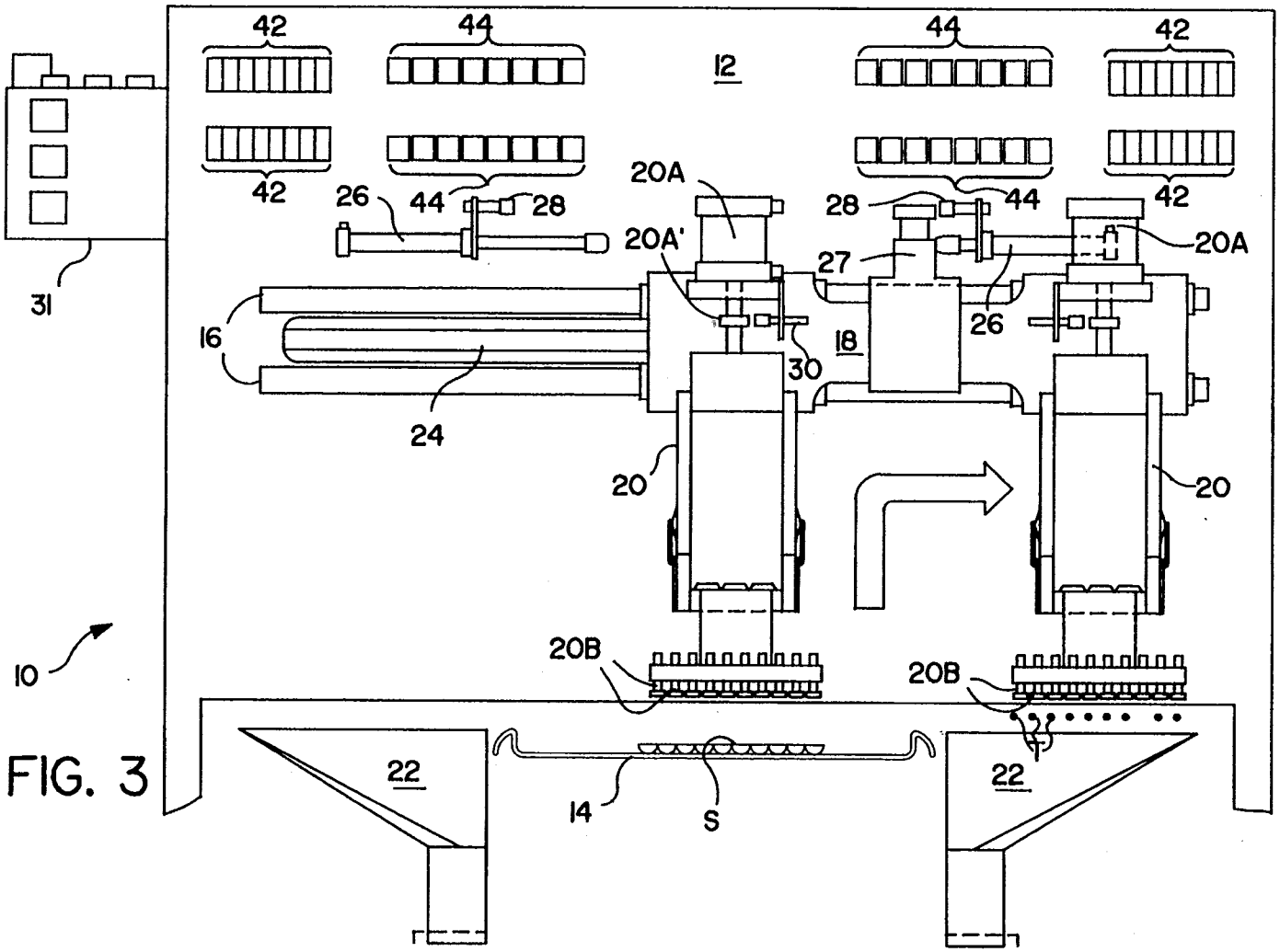
FIG. 3 shows a front elevation view (with pneumatic and electrical connections removed for clarity) of the apparatus of the invention wherein the vacuum head has been vertically shifted back to its elevated first position and then laterally shifted to the inoperative position offset from the carrier strip and at which position the goods will be pneumatically released into the goods collection means therebeneath, and wherein the second of said pair of vacuum heads has been laterally shifted into its elevated first position in vertical registration with the carrier strip in order to address the new segment of the sequentially advancing carrier strip.
Figure 4:
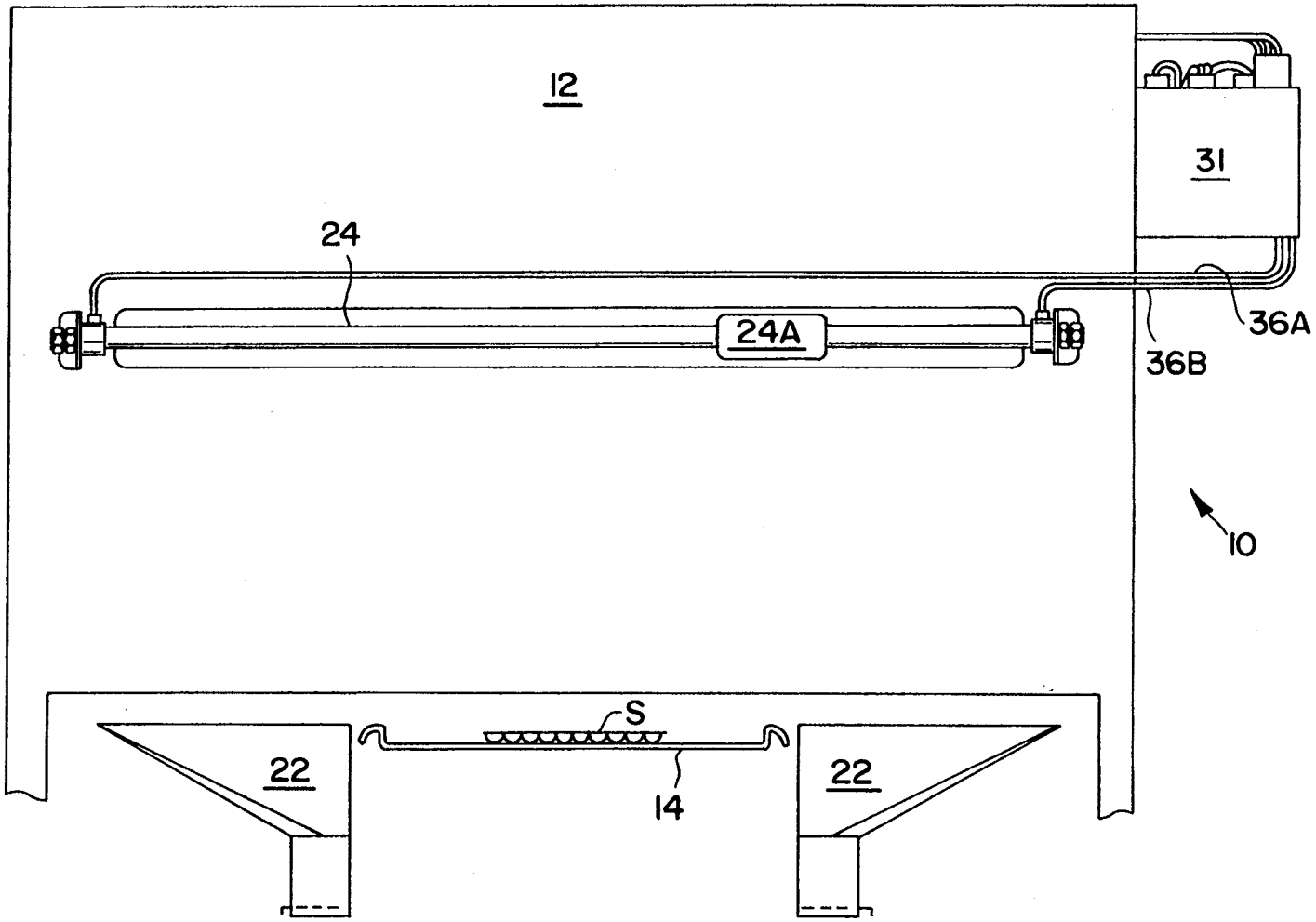
FIG. 4 shows back elevation view of the apparatus of the invention.

Referring now particularly to FIGS. 1–3 of the drawings, the operation of vacuum heads 20 will be described. As noted hereinabove, pneumatic cylinder 20A positioned at the top of each spaced-apart vacuum head 20 serves to cause suction cups 20B to vertically descend into pneumatically engaging contact with the goods carried on a corresponding portion of carrier strip S. Once a selected portion of the suction cups 20B have been pneumatically actuated during the vertical descent by pneumatic cylinder 20A so as to engage the goods in a defective blister section (see FIGS. 1 and 2), vacuum head 20 is vertically elevated to its original position by pneumatic cylinder 20A and then laterally shifted into position over collection bin 22 (see FIG. 3) by pneumatic cylinder 24 located at the rear of primary housing 12 (see FIG. 4). Suction cups 20B which have been pneumatically actuated are then deactuated so that the goods carried thereby are allowed to fall into collection bin 22 (again see FIG. 3) where they are collected for subsequent recycling to the hopper of the blister packaging machine. At this point of the operating cycle of the pneumatic heads, the second head is now in its initial raised position over a new portion of carrier strip S which has been linearly advanced so as to now be addressed by second vacuum head 20. Second vacuum head 20 will repeat the sequence of steps followed by first vacuum head 20 and thereby deliver goods from any defective blister sections within the new intermittently advanced portion of carrier strip S and deposit them into collection bin 22 on the opposing side of carrier strip guide track 14. In this matter, one complete cycle of the pick-up/laterally shift/release cycle of each vacuum head 20 has been accomplished, and original vacuum head 20 is now in position over a new intermittently advanced portion of carrier strip S and poised to remove goods from any one or more blister sections which the detection station has determined are lacking goods in one or more blister cavities thereof.

The use of two spaced-apart vacuum heads 20 allows for rapidly addressing intermittently advancing carrier strip S without causing undue wear and tear which would be inherent in the use of a single vacuum head. Although other pneumatic cylinders could be utilized for lateral shifting of support frame 18, applicants prefer the use of a FESTO rodless linear drive cylinder which utilizes a magnetic piston within the rodless drive cylinder to motivate magnetically coupled yoke 24A which is in turn secured to vacuum head support frame 18. The FESTO rodless linear drive cylinder 24 utilizes pneumatic actuation of the magnetic piston to laterally shift support frame 18 along guide rails 16 without the requisite space required by conventional piston rod-type pneumatic cylinders. The rodless cylinder utilized in the preferred embodiment of the invention is a FESTO DGO 1 inch 15.000 PPV-A rodless cylinder available from Festo Corporation of Charlotte, N.C.

Referring now specifically to FIGS. 1–3, it can be seen that a pneumatic brake 26 is secured at each side of primary housing 12 so as to contact shoulder block 27 of support frame 18 at each end of the lateral reciprocal movement thereof so as to provide a cushioned stop at each end of the reciprocating movement of vacuum heads 20. Also, optical detectors 28 are connected to each pneumatic brake 26 in order to detect the presence of shoulder block 27 of support frame 18 at each end of its reciprocally traversing motion. Optical detectors 30 provided adjacent disks 20A' on each of the pistons of pneumatic cylinders 20A when the corresponding vacuum head is in its elevated position serve to detect whether the corresponding vacuum head 20 is in its vertically elevated or vertically extended position. The electrical signals from optical detectors 28 and optical detectors 30 are in electrical connection with the PLC of the goods recycling system so that signals from the detection station and optical detectors 28 and 30 will be suitably processed by the programmable logic computer (PLC) to operate goods recycling apparatus 10.

Referring now specifically to FIGS. 5–8, the pneumatic control system for actuating pneumatic cylinders 20A, pneumatic rodless drive cylinder 24 and selected matrices of suction cups 20B will be described in detail. Firstly, it should be appreciated that control box 31 is electrically connected directly to the programmable logic computer (PLC) utilized by the blister packaging machine and a suitable high pressure air line. The PLC receives and processes signals from the detection station of the blister packaging machine in order to then send suitable control signals to control box 31 of goods recycling apparatus 10. Control box 31 comprises electrically actuated solenoid valve 32 which is a switching valve to control the flow of air to pneumatic cylinder 20A through air lines 32A, 32B in order to lower and raise first vacuum head 20 (the left vacuum head in FIGS. 1–3 and 5). Solenoid valve 34 controls the flow of air to pneumatic cylinder 20A of second vacuum head 20 (the right vacuum head in FIGS. 1–3 and 5) through lines 34A, 34B in order to lower and raise second vacuum head 20. Solenoid valve 36 serves to control the flow of air to rodless pneumatic cylinder 24 through air lines 36A, 36B (see FIG. 4) so as to laterally shift vacuum head support frame 18 as necessary to first register one of the spaced-apart pair of vacuum heads 20 with carrier strip S and then register the other of the spaced-apart pair of vacuum heads 20 with carrier strip S. Thus, the independent vertical movement of each of the two vacuum heads 20 as well as the horizontal movement of the pair of spaced-apart vacuum heads 20 is controlled by solenoid valves 32, 34 and 36, respectively. Although the choice of the solenoid valves is a matter of design choice, applicant presently prefers that MAC brand Model No. 82A-BA-BKA-TM-DDAP-IDA valves available from Fluid Power Systems of Birmingham, Ala. be utilized.

Figure 5:
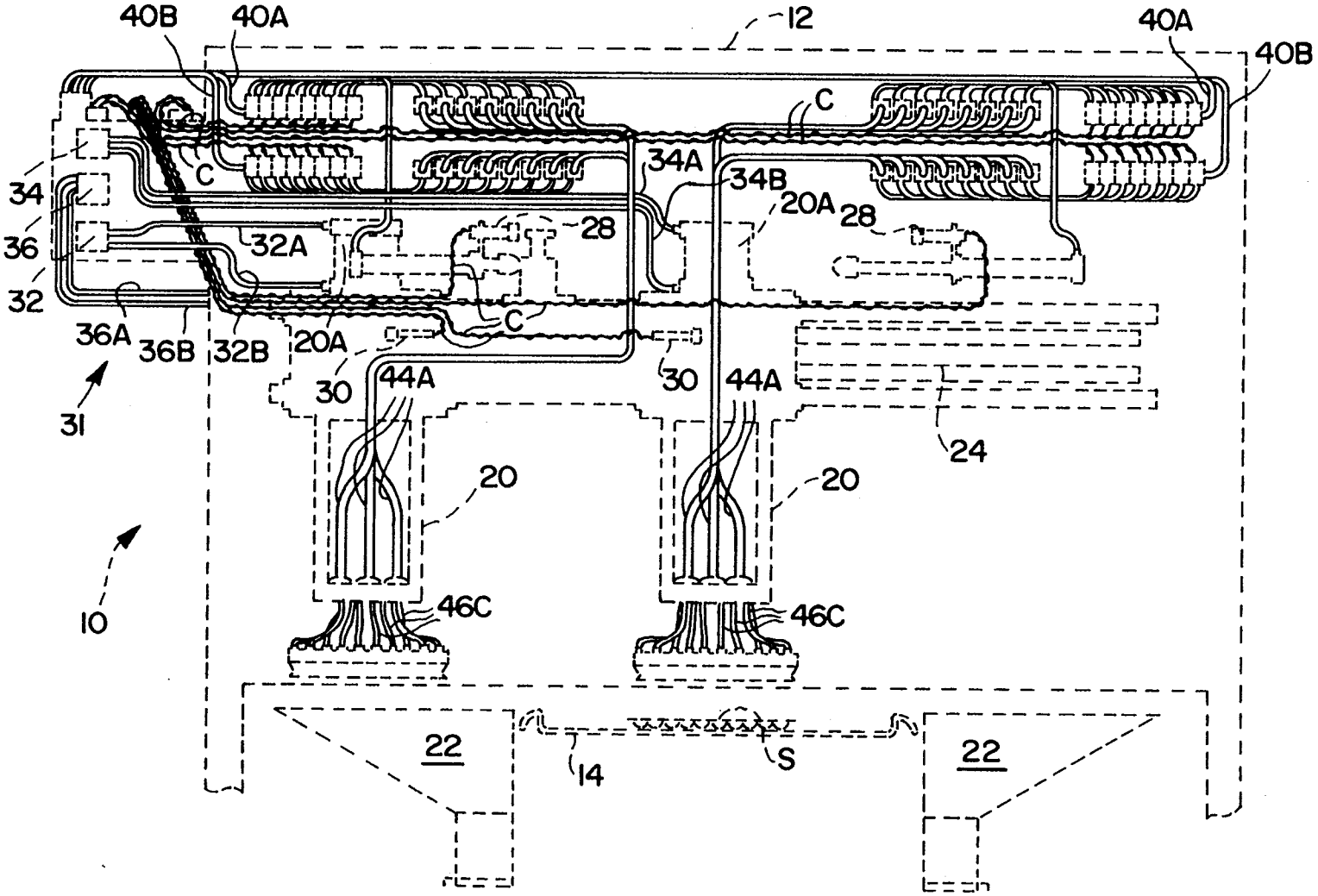
FIG. 5 shows a front elevation view of the apparatus depicting an electrical and pneumatic schematic diagram of the apparatus wherein the remaining structure of the apparatuses shown in phantom lines.
Figure 6:
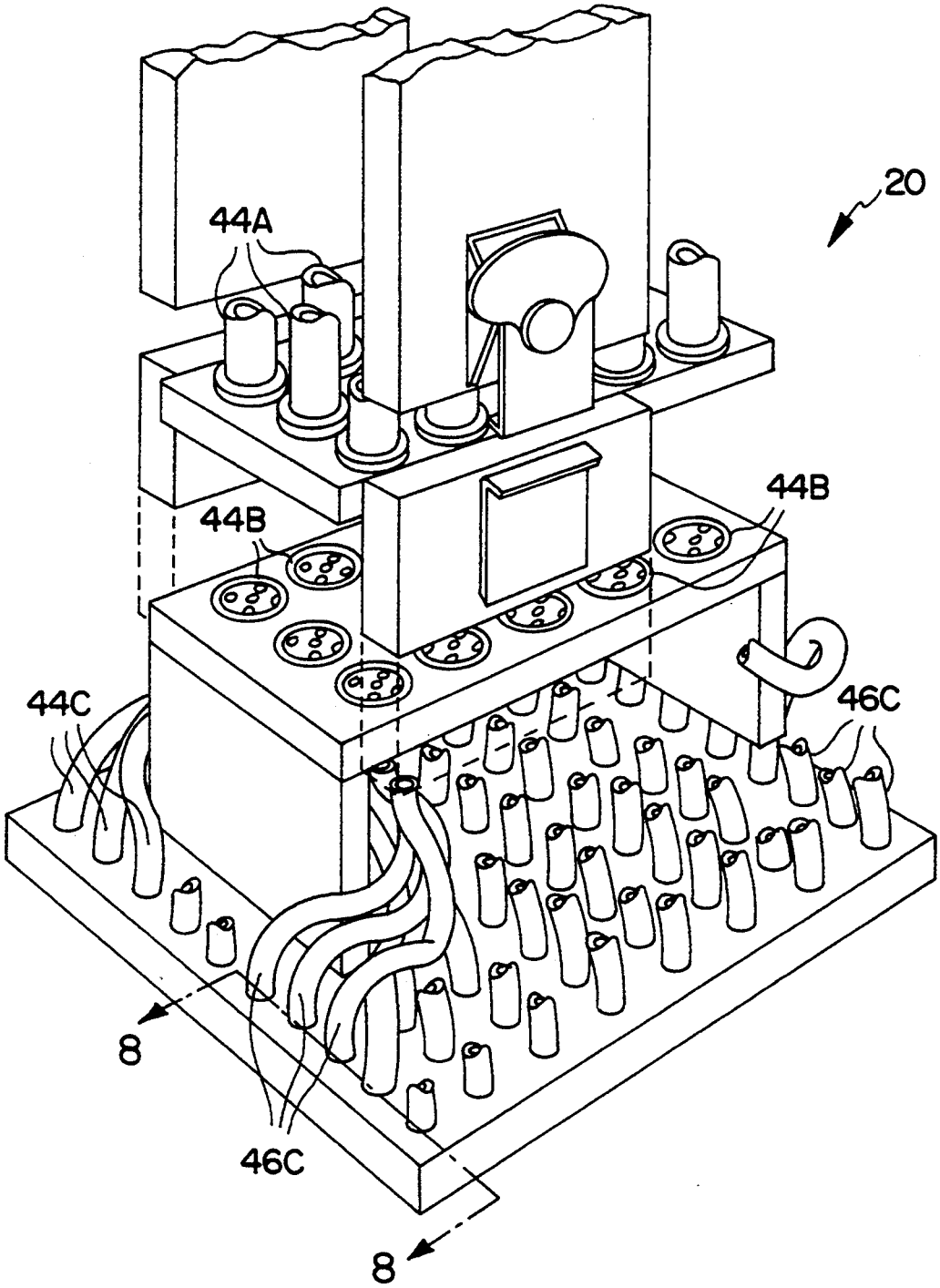
FIG. 6 shows an exploded perspective view (with parts broken away for clarity) of one of the pair of vacuum heads of the apparatus of the invention.

Referring to FIGS. 1 and 5, applicant will now describe in detail the pneumatic control system for actuating certain selected suction cups 20B positioned at the bottom of each of the pair of vacuum heads 20. Firstly, with reference to vacuum head 20 shown in FIG. 5 as being in vertical registration with carrier strip S, a continuous air supply is provided through air lines 40A, 40B to a total of sixteen (16) solenoid valves 42 positioned on the right side of primary housing 12. Each of 16 solenoid valves 42 is independently electrically actuated by the PLC through electrical connection C to control box 31. 16 solenoid valves 42 are each in pneumatic connection with a corresponding one of 16 air pumps 44. Thus, when electrically actuated, each individual solenoid valve 42 will provide air pressure to a corresponding individual one of the 16 air pumps 44. Each of 16 air pumps 44 includes a pneumatic tube 44A extending therefrom and downwardly into vacuum head 20 (see also FIG. 6). Thus, when one or more solenoid valves 42 are electrically actuated, an air flow will be created at each of a corresponding one or more of air pumps 44 which will in turn create a vacuum in each of the corresponding one or more pneumatic tubes 44A connected thereto and extending downwardly into vacuum head 20. In this fashion, vacuum can be selectively applied to any one or more of the 16 pneumatic tubes 44A extending into vacuum head 20 (see FIGS. 5 and 6).

Figure 7:
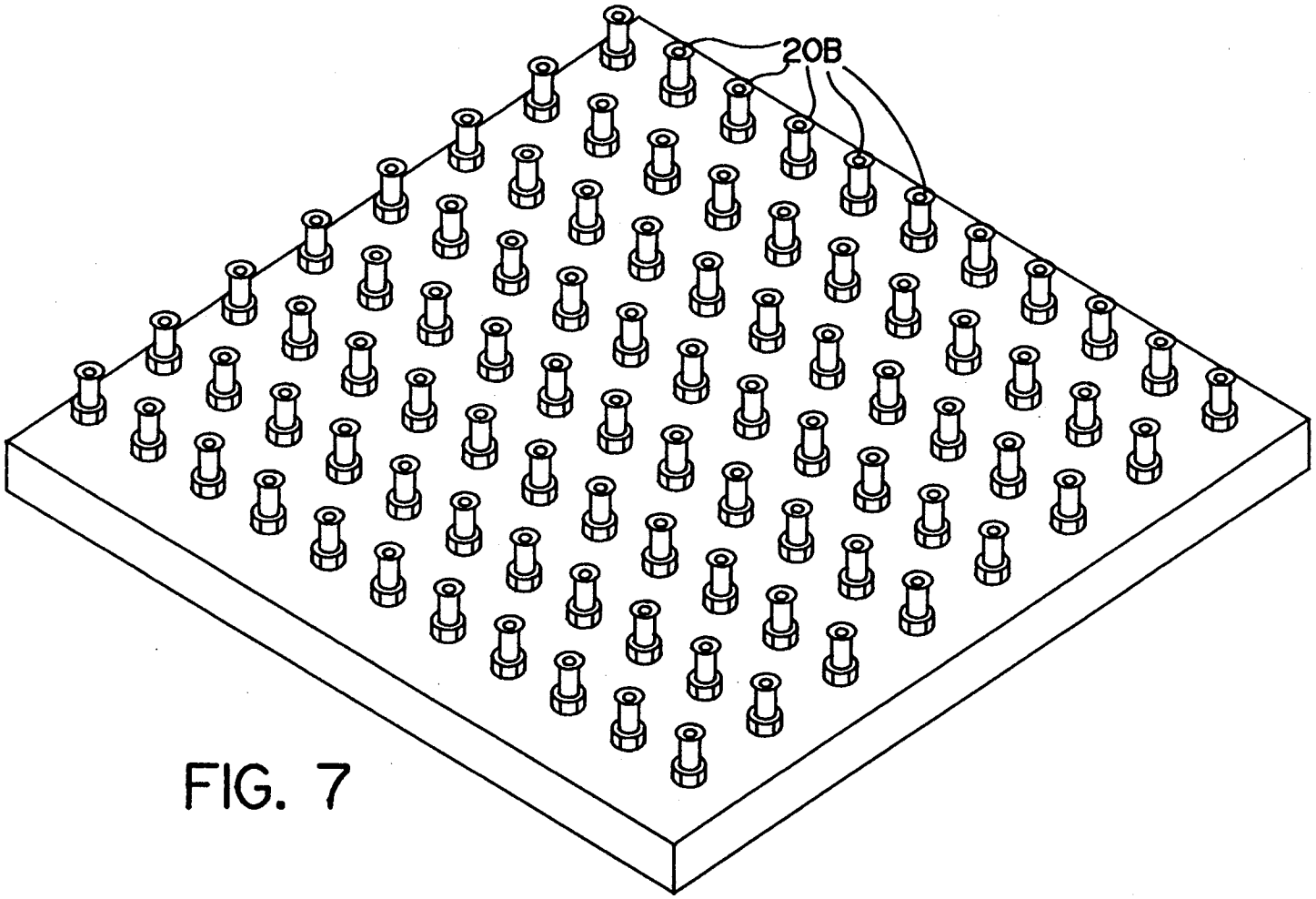
FIG. 7 shows a perspective view of the underside of the vacuum head shown in FIG. 6 with particular emphasis on the suction cups depending therefrom.
Figure 8:
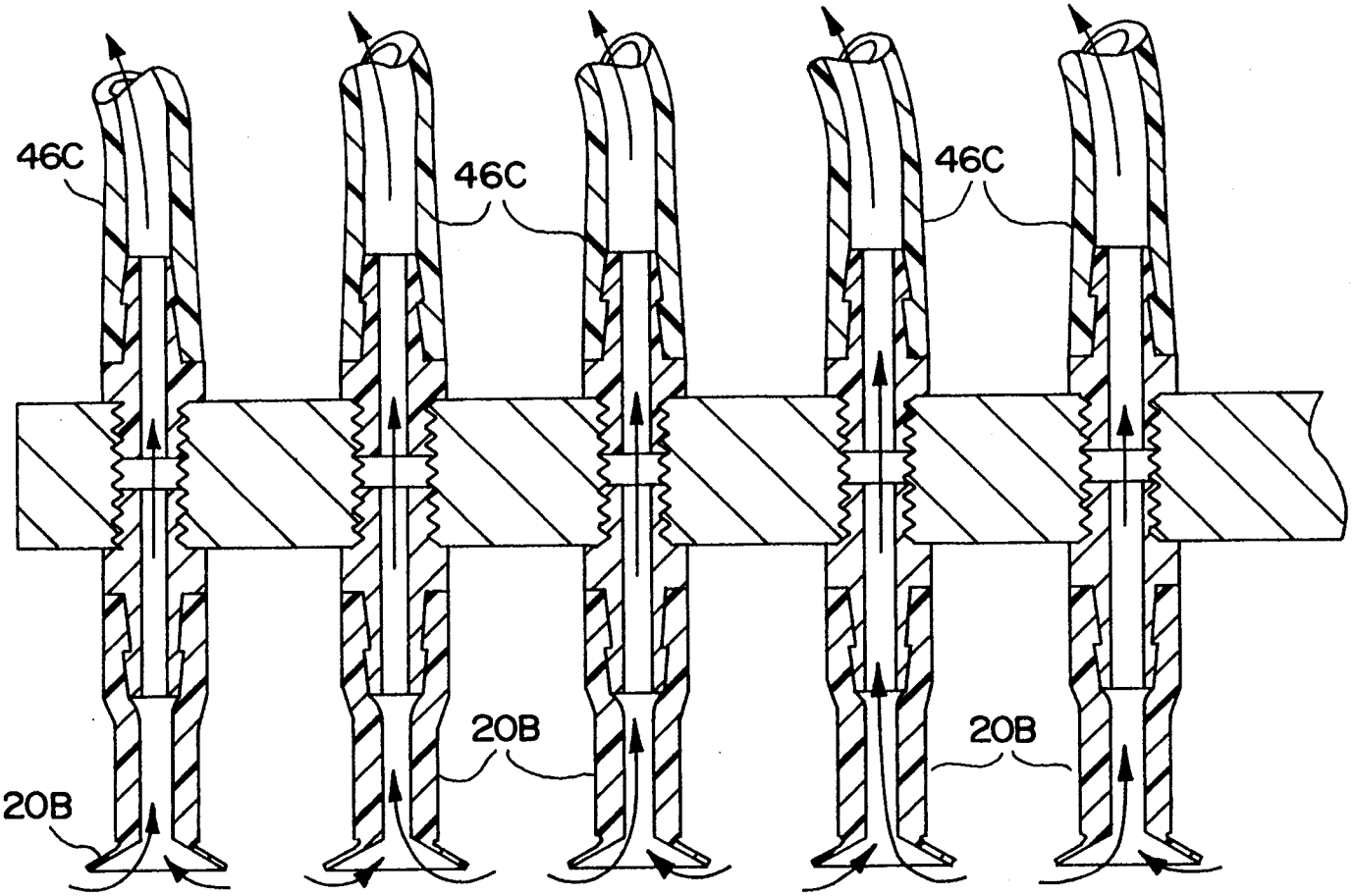
FIG. 8 shows an enlarged vertical section taken along line 8—8 of FIG. 6 illustrating the suction cups utilized by the pair of vacuum heads of the apparatus of the invention.
Figure 9:
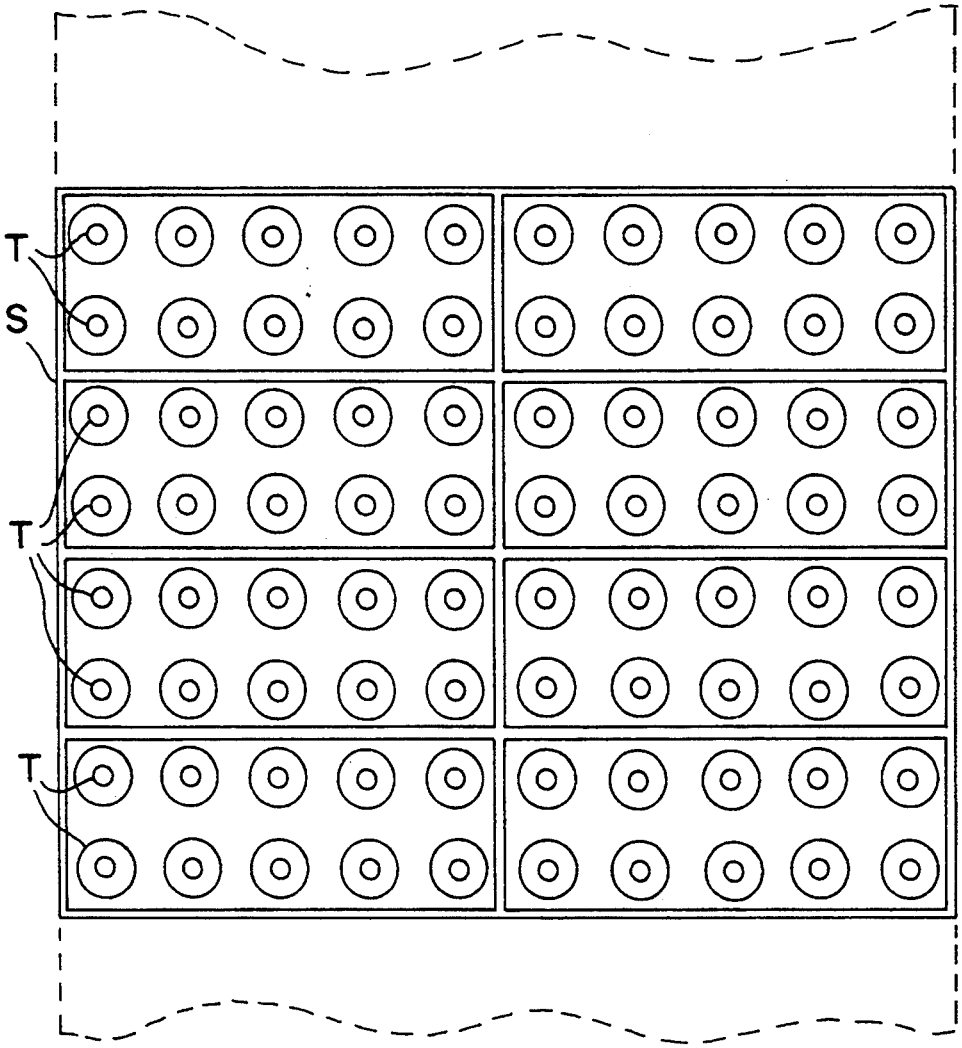
FIG. 9 shows a plan view of 8 blister sections defined within the length of one intermittent advancement of the carrier strip.
Figure 10:
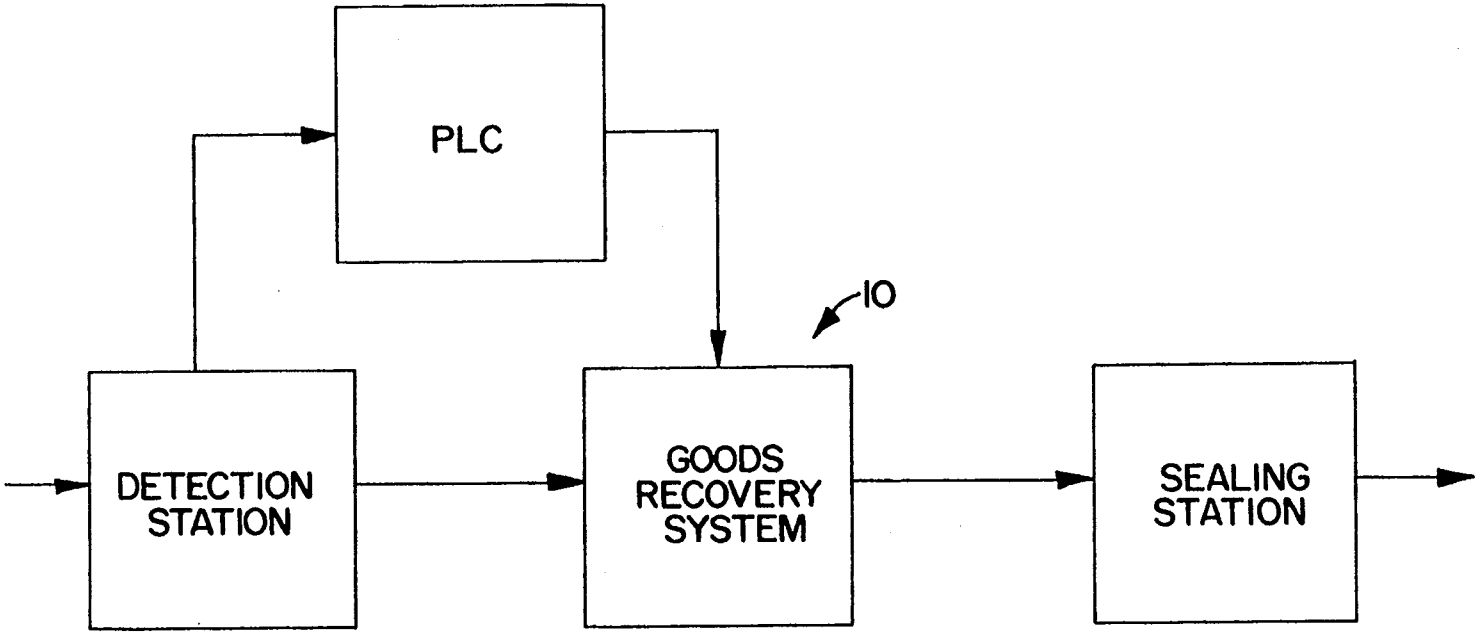
FIG. 10 shows a schematic view of the apparatus of the invention in its environment between the detection station and the sealing station of a blister packaging machine.

In order to provide the ability to draw a vacuum on the large number of suction cups 20B (e.g., a 10×8 matrix of 80 suction cups 20B as shown in FIG. 7 to address the aforementioned representative intermittent carrier strip section defining eight 2×5 blister sections as shown in FIG. 9) each of 16 pneumatic tubes 44A is coupled into a corresponding manifold coupling 44B. Although a matter of design choice, apparatus 10 as shown in the drawings comprises 5 secondary pneumatic tubes 46C extending from each manifold coupling 44B to 5 suction cups 20B depending downwardly from the bottom of vacuum head 20 (see FIGS. 6 and 8). In this fashion, actuation of a single solenoid 42 serves to actuate a corresponding single air pump 44 and thereby provide vacuum suction to five suction cups 20B through corresponding pneumatic tube 44A and 5 secondary pneumatic tubes 46C fluidly coupled thereto at corresponding manifold coupling 44B. Therefore, the PLC of the blister packaging machine goods recycling system is able to selectively control discrete groups of 5 suction cups 20B of the total 80 suction cups 20B in order to selectively apply a vacuum to each defective 2×5 blister section of the 8 blister sections which pass beneath vacuum head 20 with each intermittent advancement of the blister packaging machine. The other of the pair of spaced-apart vacuum heads 20 functions in the identical manner as the first head described in detail hereinabove by means of its own set of 16 solenoid valves 42 and 16 pneumatically connected air pumps 44 (positioned on the left side of primary housing 12.

Also shown in FIG. 5 are electrical connections C extending from control box 31 to spaced-apart optical detectors 28 for determining whether vacuum head support frame 18 is at the left side of its reciprocal traversing motion (see FIGS. 1 and 2) or the right side of its reciprocal traversing motion (see FIG. 3), and optical detectors 30 associated with each respective vacuum head 20 for determining whether the vacuum head is in the vertically raised or vertically lowered position.

Although other devices could be utilized, applicant contemplates that pneumatic cylinders 20A are most suitably BIMBA brand Model No. FO-17-0.625-9-V cylinders available from Dixie Industrial Equipment Co. of Birmingham, Ala.; solenoid valves 42 are most suitably MAC brand Model No. 35A-BAE-DDAJ-IKA valves available from Fluid Power Systems; and air pumps 44 are DIAB brand Model No. 32/01,046L60X1 air pumps available from Fluid Power Systems.

In use, the invention contemplates a blister packaging process providing for pneumatic recovery for subsequent recycling of goods such as pharmaceutical tablets or capsules from defective blister packages during the operation of a blister packaging machine. A plurality of blisters are formed in a carrier strip wherein the carrier strip will be subsequently separated into a plurality of blister sections which each contain a plurality of blister cavities. The blisters in the carrier strip are filled with goods and the carrier strip is detected across the width thereof to determine the presence of empty blister cavities in the carrier strip prior to separation of the blister sections from the carrier strip at the blister package forming station.

Between the detection station and the sealing station of the blister packaging machine a pair of spaced-apart and laterally shiftable vacuum heads are provided which are reciprocally mounted above the carrier strip so that when one head is in vertical registration with the carrier strip therebeneath the other head is laterally offset from the carrier strip. The heads each comprise a plurality of suction elements depending from the bottom thereof and adapted to engage a predetermined plurality of goods on the carrier strip. Control means is provided for causing each of the pair of spaced-apart heads when positioned over the carrier strip to descend and pneumatically engage a selected portion of the plurality of goods with the suction elements thereof, to return to the raised position and to then shift to the laterally offset position and to release the plurality of goods into a collection container.

The blisters of the carrier strip are then sealed with an overlaying strip, and the blister packages are formed by separating the plurality of blister sections from the carrier strip. Finally, the empty defective blister packages are segregated from the non-defective blister packages.

It will be understood that various details of the invention may be changed without departing from the scope of the invention. Furthermore, the foregoing description is for the purpose of illustration only, and not for the purpose of limitation—the invention being defined by the claims.

What is claimed is:

1. In combination with a blister packaging machine comprising a blister forming station for forming a plurality of blisters in a carrier strip, a blister filling station for introducing goods to be packaged into the blisters in the carrier strip, a detection station for detecting empty blisters in the carrier strip, a sealing station for closing the blisters in the carrier strip, a blister package forming station for detaching blister sections from the carrier strip, and a segregating station for separating defective blister sections from non-defective blister sections, the improvement comprising a goods recovery apparatus between the detection station and the sealing station for removing goods from predetermined portions of the carrier strip from which blister sections will be formed and which have one or more empty blisters, said apparatus comprising;

(a) one or more laterally shiftable heads mounted above said carrier strip so as to move from a position in vertical registration with said carrier strip to a position laterally offset from said carrier strip, said head comprising one or more engagement elements depending from the bottom thereof and adapted to engage goods on said carrier strip;

(b) first actuator means associated with said head for vertically shifting said head from an elevated first position to a lowered goods-contacting second position and back to said elevated first position when said head is positioned over said carrier strip;

(c) second actuator means associated with said head for laterally shifting said head from a first operative position in vertical registration with said carrier strip to a second inoperative position laterally offset from said carrier strip and back to said first operative position;

(d) third actuator means associated with said head to operate said one or more engagement elements thereof for a predetermined period of time;

(e) goods collection means provided adjacent at least one side of said carrier strip so as to provide a portion thereof beneath said head when said head is in its laterally offset inoperative position; and (f) control means cooperatively associated with said first, second and third actuator means for causing said head when operatively positioned over said carrier strip to descend from said first position, engage a selected portion of said goods with said one or more engagement elements thereof, return to said first position, shift to said laterally offset inoperative position over said goods collection means and release said goods therein.

2. The combination defined in claim 1 wherein said one or more heads comprises a pair of spaced-apart heads reciprocally mounted above said carrier strip so that when one head is in vertical registration with said carrier strip the other head is laterally offset from said carrier strip.

3. The combination defined in claim 1 wherein said head addresses a length of said carrier strip therebeneath comprising a plurality of blister sections in the width direction and a plurality of blister sections in the length direction.

4. The combination defined in claim 1 wherein said first actuator means comprises an air cylinder operatively connected to said head.

5. The combination defined in claim 1 wherein said second actuator means comprises an air cylinder operatively connected to said head.

6. The combination defined in claim 1 wherein said third actuator means comprises a vacuum line with one or more air valves each being in fluid connection with a respective one of said one or more engagement elements.

7. The combination defined in claim 1 wherein said goods collection means comprises a goods collection bin positioned on each side of said carrier strip wherein each bin is adapted for periodic removal of the goods collected therein.

8. The combination defined in claim 1 wherein said goods collection means comprises a goods collection funnel on each side of said carrier strip which each communicate with a singular collection container.

9. The combination defined in claim 1 wherein said control means comprises suitable computer means in electrical connection with said detection station and adapted to respond to signals from said detection station by selectively actuating said first, second and third actuator means.

10. In combination with a blister packaging machine comprising a blister forming station for forming a plurality of blisters in a carrier strip, a blister filling station for introducing goods to be packaged into the blisters in the carrier strip, a detection station for detecting empty blisters in the carrier strip, a sealing station for closing the blisters in the carrier strip, a blister package forming station for detaching blister sections from the carrier strip, and a segregating station for separating defective blister sections from non-defective blister sections, the improvement comprising a pneumatic goods recovery apparatus between the detection station and the sealing station for removing goods from predetermined portions of the carrier strip from which blister sections will be formed and which have one or more empty blisters, said apparatus comprising;

(a) A pair of spaced-apart and laterally shiftable vacuum heads reciprocally mounted above said carrier strip so that when one head is in vertical registration with said carrier strip the other head is laterally offset from said carrier strip, said heads each comprising a plurality of suction elements depending from the bottom thereof and adapted to engage a predetermined plurality of goods on said carrier strip;

(b) first pneumatic means associated with said vacuum heads for vertically shifting each of said vacuum heads from an elevated first position to a lowered goods-contacting second position and back to said elevated first position when said vacuum head is positioned over said carrier strip;

(c) second pneumatic means associated with said pair of vacuum heads for laterally shifting said pair of vacuum heads so that as one head is shifted from a first inoperative position laterally offset from said carrier strip to a second operative position in vertical registration with said carrier strip and back to said first inoperative position, the other vacuum head is simultaneously being shifted from a first operative position in vertical registration with said carrier strip to a second inoperative position laterally offset from said carrier strip and back to said first operative position;

(d) third pneumatic means associated with each of said vacuum heads for providing a vacuum to a selected portion of said suction elements thereof for a predetermined period of time;

(e) goods collection means provided adjacent each side of said carrier strip so as to provide a portion thereof beneath each of said heads when said head is in its laterally offset inoperative position; and (f) control means cooperatively associated with said first, second and third pneumatic means for sequentially causing each of said pair of spaced-apart heads when operatively positioned over said carrier strip to descend from said first position, pneumatically engage a selected portion of said plurality of goods with said suction elements thereof, return to said first position, shift to said laterally offset inoperative position over said goods collection means and pneumatically release said plurality of goods therein;

whereby upon receiving a signal from said detection station, said pneumatic goods recovery apparatus will pneumatically withdraw the goods from selected portions of the carrier strip from which blister sections will be formed and which each have one or more empty blisters therein and deposit them in said goods collection means adjacent each side of said carrier strip.

11. The combination defined in claim 10 wherein said vacuum heads each address a length of said carrier strip therebeneath comprising a plurality of blister sections in the width direction and a plurality of blister sections in the length direction.

12. The combination defined in claim 10 wherein said first pneumatic means comprises a pair of air cylinders each being operatively connected to a respective one of said vacuum heads.

13. The combination defined in claim 10 wherein said second pneumatic means comprises an air cylinder operatively connected to said pair of vacuum heads.

14. The combination defined in claim 10 wherein said third pneumatic means comprises a plurality of air valves each being in fluid connection with at least one of said plurality of suction elements.

15. The combination defined in claim 10 wherein said goods collection means comprises a goods collection bin positioned on each side of said carrier strip wherein each bin is adapted for periodic removal of the goods collected therein.

16. The combination defined in claim 10 wherein said goods collection means comprises a goods collection funnel on each side of said carrier strip which each communicate with a singular collection container.

17. The combination defined in claim 10 wherein said control means comprises suitable computer means in electrical connection with said detection station and adapted to respond to signals from said detection station by selectively actuating said first, second and third pneumatic means.

18. A blister packaging process providing for the recovery and recycling of goods from defective blister packages, comprising the steps of:

(a) forming one or more blisters across the width of a progressively advancing carrier strip;

(b) filling said one or more blisters in said carrier strip with goods which are to be blister packaged;

(c) sensing the presence of empty blisters in said carrier strip;

(d) providing one or more laterally shiftable heads mounted above said carrier strip so as to move from a position in vertical registration with said carrier strip to a position laterally offset from said carrier strip, wherein said head comprises one or more engagement elements depending from the bottom thereof and adapted to engage goods on said carrier strip;

(e) providing control means for causing said head when positioned over said carrier strip to descend and engage one or more defective blister package sections of said goods with said one or more engagement elements thereof, raise upwardly and shift to said laterally offset position, and release said goods into a collection container;

(f) sealing said blisters of said carrier strip with an overlaying strip;

(g) forming blister packages by separating a plurality of blister package sections containing one or more blisters from said carrier strip; and (h) sorting defective blister packages from which the goods have been removed from non-defective blister packages.

19. A blister packaging process according to claim 18 wherein said goods are pharmaceutical goods.

20. A blister packaging process according to claim 19 wherein said pharmaceutical goods are selected from the group consisting of tablets, capsules, caplets, soft gels, lozenges and suppositories.

21. A blister packaging process according to claim 18 wherein said goods removed from said carrier strip and collected in said container are removed therefrom for reprocessing by said blister packaging process.

22. A blister packaging process providing for the pneumatic recovery and recycling of goods from defective blister packages, comprising the steps of:

(a) forming a plurality of blisters across the width of a progressively advancing carrier strip wherein said carrier strip will be subsequently separated into a plurality of blister sections each containing a plurality of blisters therein;

(b) filling said plurality of blisters in said carrier strip with goods which are to be blister packaged;

(c) sensing across said carrier strip the presence of empty blisters in said carrier strip prior to separation of said blister sections from said carrier strip;

(d) providing a pair of spaced-apart and laterally shiftable vacuum heads which are reciprocally mounted above said carrier strip so that when one head is in vertical registration with said carrier strip the other head is laterally offset from said carrier strip, wherein said heads each comprise a plurality of suction elements depending from the bottom thereof and adapted to engage a predetermined plurality of goods on said carrier strip;

(e) providing control means for sequentially causing each of said pair of spaced-apart heads when positioned over said carrier strip to descend and pneumatically engage one or more defective blister package sections of said plurality of goods with said suction elements thereof, raise upwardly and shift to said laterally offset position, and pneumatically release said plurality of goods into a collection container;

(f) sealing said blisters of said carrier strip with an overlaying strip;

(g) forming said blister packages by separating said plurality of blister sections from said carrier strip; and (h) sorting defective blister packages from which the goods have been pneumatically removed from non-defective blister packages.

23. A blister packaging process according to claim 22 wherein said goods are pharmaceutical goods.

24. A blister packaging process according to claim 23 wherein said pharmaceutical goods are selected from the group consisting of tablets, capsules, caplets, soft gels, lozenges and suppositories.

25. A blister packaging process according to claim 22 wherein said goods removed from said carrier strip and collected in said container are removed therefrom for reprocessing by said blister packaging process.

* * * * *

UNITED STATES PATENT AND TRADEMARK OFFICE

CERTIFICATE OF CORRECTION

PATENT NO. : 5,442,892

DATED : August 22, 1995

INVENTOR(S) : Henry K. Burns

It is certified that error appears in the above-identified patent and that said Letters Patent is hereby corrected as shown below:

On the title page, item [54]

After "SYSTEM", change "FOR" to --TO--.

Signed and Sealed this

Fourteenth Day of November, 1995

*Attest:*

*Attesting Officer*

BRUCE LEHMAN

*Commissioner of Patents and Trademarks*